United States Patent [19]

Nielsen

[11] Patent Number: 4,511,945

[45] Date of Patent: Apr. 16, 1985

[54] SOLENOID SWITCHING DRIVER WITH FAST CURRENT DECAY FROM INITIAL PEAK CURRENT

[75] Inventor: Arnold D. Nielsen, Wayne, Mich.

[73] Assignee: Ford Motor Company, Dearborn, Mich.

[21] Appl. No.: 565,796

[22] Filed: Dec. 27, 1983

[51] Int. Cl.[3] ..... H01H 47/32

[52] U.S. Cl. ..... 361/154; 361/152; 123/490

[58] Field of Search ..... 361/152, 154; 123/490

[56] References Cited

U.S. PATENT DOCUMENTS 3,581,156 5/1971 Dolbachian et al. .
4,180,026 12/1979 Schulzke et al. .
4,327,394 4/1982 Harper .
4,347,544 8/1982 Ohba .
4,360,855 11/1982 Ohba .

OTHER PUBLICATIONS

Publication by SGS-ATES Semiconductor Corporation in Jun. 1982 Entitled: Injector Driver Control-Tentative Data.

*Primary Examiner*—Reinhard J. Eisenzopf
*Attorney, Agent, or Firm*—Peter Abolins; Robert D. Sanborn

[57] ABSTRACT

A solenoid driver circuit has reduced power consumption by providing relatively fast current decay to a sustaining low current after an initial peak activation current. Subsequent sustaining current peak applications have a smaller magnitude than the initial peak current and are followed by slower decays for a predetermined length of time to a lower current level. Two transistors and a Zener diode are operatively connected to the solenoid and controlled by a logic circuit to apply the desired current to the solenoid. The two transistors are turned on and off using logic flip-flops to sense voltage comparisons with the initial peak current voltage, the sustaining peak current, and the sustaining low current. A logic signal is generated as a function of the predetermined length of time, and an output signal is coupled to the bases of the two transistors to control their on/off states.

11 Claims, 15 Drawing Figures

Ip
ISUS PK
COIL CURRENT
ISUS LO
T1

VOLTAGE ACROSS RSENSE

Ip
C
A
E

ISUS LO
F

INVERSE ISUS LO
B
D
G
H

ISUS PK
SEE TEXT

SOLENOID SWITCHING DRIVER WITH FAST CURRENT DECAY FROM INITIAL PEAK CURRENT

BACKGROUND OF THE INVENTION

1. Technical Field

This invention relates to controlling the flow of current to the coil of a solenoid.

2. Background Art

Various circuitry for driving solenoids is known. For example, it is known to apply a driving current to a solenoid in accordance with a periodic function, such as a square wave, thus energizing the solenoid with an average current less than the maximum applied current. It is also known that after a solenoid is energized and initial displacement has taken place, a reduced amount of power is necessary to maintain the solenoid in an energized condition. Thus, it is possible to reduce power consumption in a solenoid by initially applying a higher peak current magnitude and then reducing the current to a lower sustaining value. Such a current reduction can take place, for example, after a certain amount of time has passed. However, reliance upon the passage of a predetermined amount of time may be undesirable in that it may not accurately reflect the actual condition and current requirements of the solenoid. That is, current may be reduced before the solenoid is fully energized or current may be maintained at a high level an unnecessarily long period of time after the solenoid is energized.

Specific examples of circuitry for driving solenoids include U.S. Pat. No. 4,180,026 to Schulzke et al. which teaches a pair of transistors to drive a solenoid. One of the transistors is turned on only between driving periods. Solenoid driving circuits with two transistors are also taught in patents to Ohba, U.S. Pat. Nos. 4,347,544 and 4,360,855. U.S. Pat. No. 3,581,156 to Dolbachian et al. teaches an electromagnetic clutch driver having switches by which the clutch coil can be driven in a variety of modes. U.S. Pat. No. 4,327,394 to Harper teaches a relatively slow decay from a peak current to a sustaining current. Such a slow decay can be unacceptable for proper actuation of fuel injectors. The circuit taught by Harper is constrained from speeding up the decay by the time constant due to the inductance and resistance of the circuitry.

In particular, it is known to use a switching coil driver to control current to automotive fuel injector and transmission solenoids and to use switching (on-off) techniques to both minimize power dissipation and, in some cases, minimize solenoid non-linearity and hysteresis.

A solenoid driver may supply current to the coil as a current sinking or a current sourcing device. As a current sinking device, one side of the coil is connected to the battery. The solenoid is turned on by grounding (sinking) the other side of the coil through a switch such as a transistor. As a current sourcing device, one side of the coil is connected to ground. The solenoid is turned on by connecting the other side of the coil to battery voltage through a switch. This configuration has the advantage of protecting for an accidental short to ground in the wiring harness between the driver and the solenoid. If this happens the solenoid will turn off rather than on, as would happen with the current sinking configuration. Turning the solenoid off is a preferred failure mode since it is advantageous to have the primary failure mode (open electrical connection) the same as the secondary failure mode (short to ground). Both configurations have the advantage of requiring only one wire from the driver to the solenoid.

A publication by SGS-ATES Semiconductor Corporation in June 1982 entitled "Injector Driver Control—Tentative Data Sheet" discloses a current sinking device with a series transistor controlling flow through a solenoid coil and a sensing resistor. A second transistor selectively provides a current path parallel to the solenoid coil. The two transistors are controlled to reduce solenoid current from an initial peak current to reduced magnitude sustaining currents.

Even though reducing solenoid driving current from a peak current to a sustaining current is known, it is still desired to obtain a means to rapidly and accurately decay the driving current from an initial peak to a sustaining level. When this current decay is based upon a predetermined time, the decay time may not take into account injector and circuit variations. It would be desirable to avoid such limitations. In particular, an improved logic for controlling solenoid driving current would be desirable. This would improve efficiency and reduce power consumption. These are some of the problems this invention overcomes.

DISCLOSURE OF THE INVENTION

A solenoid driver circuit controls the application of current to a solenoid coil and reduces the total power dissipation. A first and a second transistor are operatively coupled to control current flow through the solenoid. A first sense resistor is coupled in series with the solenoid to sense current in the solenoid. A first comparator means is coupled to the sense resistor to compare voltage sensed across the sense resistor to at least one control voltage. A logic means is coupled to the comparator means for switching the first and second transistor means on and off as a function of the output of the comparator so that the solenoid driver circuit applies an initial peak current to the solenoid. After the initial peak current is applied, the current rapidly decays to a smaller predetermined sustaining low current value. Thereafter, reduced magnitude sustaining peak currents are successively applied with intermediate decay periods of a predetermined length. The initial decay to the predetermined sustaining low current value is substanitally faster than the subsequent successive decays of predetermined length. Thus, the relatively fast initial current decay from the initial peak current magnitude reduces power consumption. Subsequent decays, after initial energization are slower since a transistor switch inserts a diode across the solenoid at that time thus creating a larger time constant.

In one embodiment, the solenoid driver circuit is triggered by a digital input applied to the logic means. When the current through the sense resistor reaches a first level, the first comparator generates a voltage which causes the logic means to turn off the first transistor coupled in series with the solenoid. A decay current then flows through the sense resistor via a zener diode and the first transistor. When the decay current falls to a second level, a second comparator generates a voltage which causes the logic means to turn on both the first and second transistor. Subsequently, when the sensed current rises to a third level, a third comparator causes the first transistor to turn off and a decay current flows throught the second transistor until a specified time has elapsed. Subsequently, the first transistor is turned on and the cycle repeats until the digital input terminates.

The logic means includes four flip-flop means, three OR gate means and three AND gate means. A first flip-flop means is coupled to the first comparator means for generating a logic state. A second flip-flop means is coupled to the second comparator means for generating a logic state. A first OR gate is coupled to the second comparator. A second OR gate is coupled to the third comparator and the third flip-flop means. A first AND gate is coupled to the second flip-flop means. A second AND gate means is coupled to the second OR gate means and adapted to receive a digital input. A fourth flip-flop means is coupled to the first and second AND gate means for generating a logic signal. A first timer means is coupled to the fourth flip-flop means. A third OR gate means is coupled to the first and fourth flip-flop means and the first AND gate for timing the length of the predetermined current decay period. A third AND gate is coupled to the third OR gate and to the digital input. The first transistor means is coupled to the third AND gate means. The second transistor means is coupled to the second flip-flop means.

DETAILED DESCRIPTION OF THE INVENTION

Figure 2:
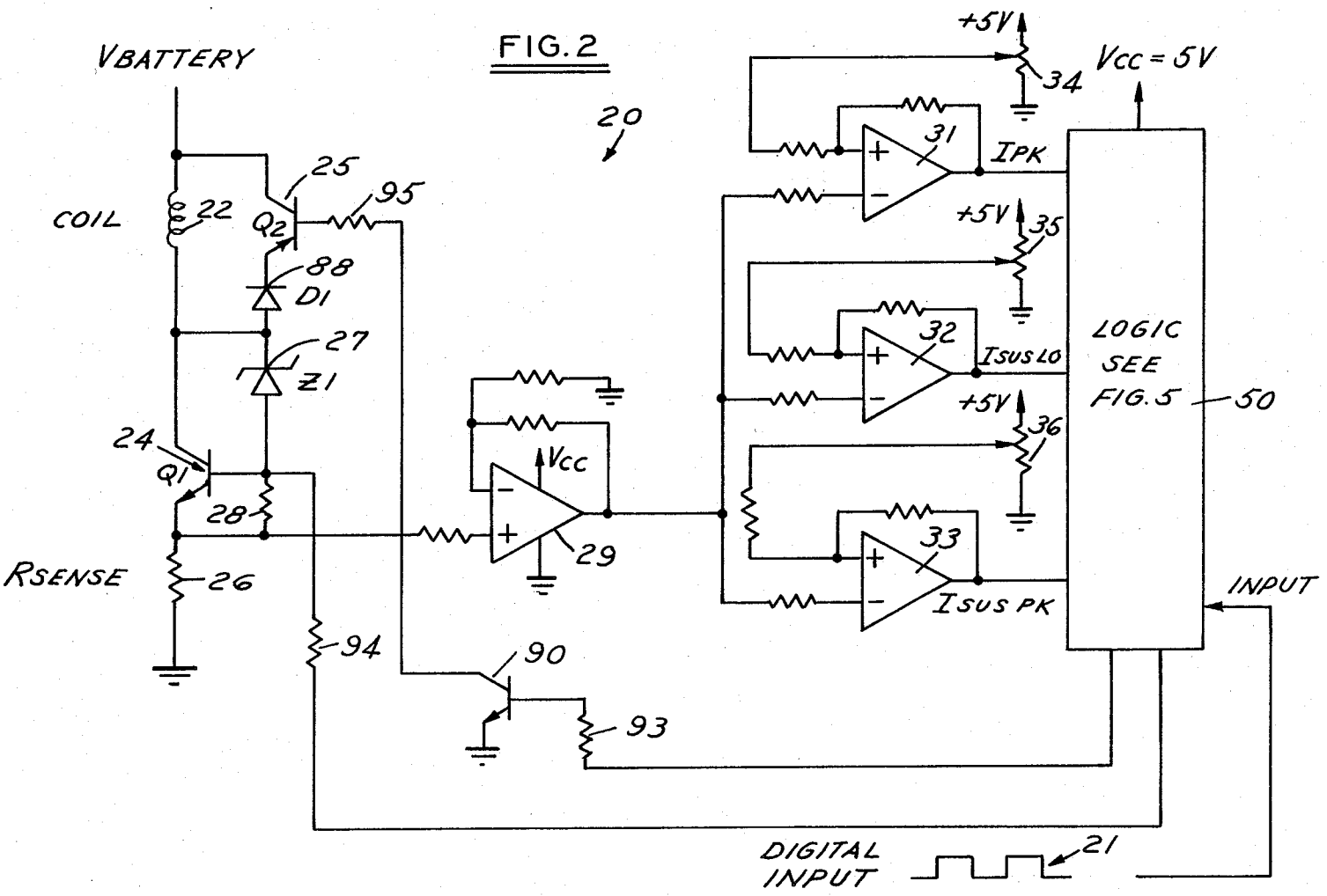
FIG. 2 is a schematic, partly block, diagram of a solenoid driver circuit coupled as a sinking driver and associated with the wave forms of FIGS. 1A, 1B and 1C.
Figure 4:
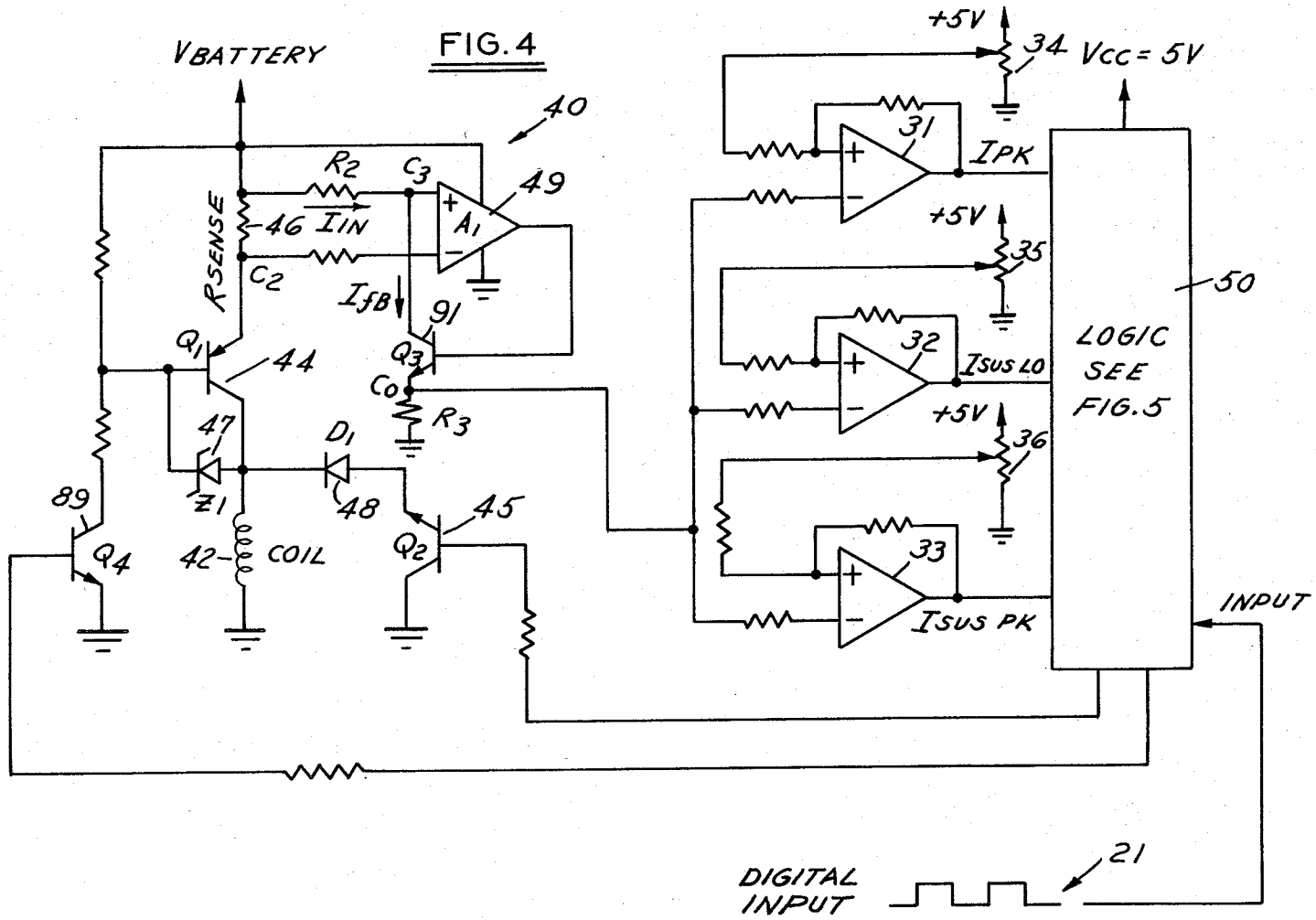
FIG. 4 is a schematic, partly block, diagram of a sourcing solenoid driver circuit connected between the solenoid coil and a battery potential, producing the wave forms associated with FIGS. 3A, 3B and 3C.

Solenoid driving circuits 20 of FIG. 2 and 40 of FIG. 4 each include a digital input 21 applied to a logic circuit 50. When digital input 21 goes to a logic high level, full battery voltage is applied to a coil (22, 42) until a specified initial peak current is reached. After this current level is reached, solenoid driver circuit 20, 40 operates to reduce coil current to a lower, predetermined sustaining low current. Subsequently, coil current is switched between a predetermined sustaining peak current and a lower current value, the current decay being a predetermined time period, using switching transistors until the digital input signal to logic circuitry 50 goes low and terminates. The sustaining peak current is a smaller magnitude than the initial peak current. Using a digital input signal pulse train of constant frequency but variable duty cycle, a desired average coil current can be achieved. Thus, a coil control parameter, such as fuel flow, can be regulated via an input duty cycle applied to logic circuit 50.

Figure 3A:
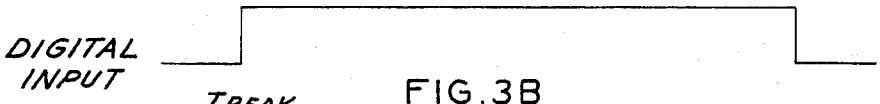
FIGS. 3A, 3B and 3C are a series of wave forms with respect to the time similar to FIGS. 1A, 1B and 1C, but associated with a sourcing driver coupled between the driven solenoid and a voltage source, FIG. 3A being a digital input to the solenoid driver circuit with respect to time, FIG. 3B being the solenoid coil current with respect to time, and FIG. 3C being the solenoid coil voltage with respect to time.
Figure 3B:
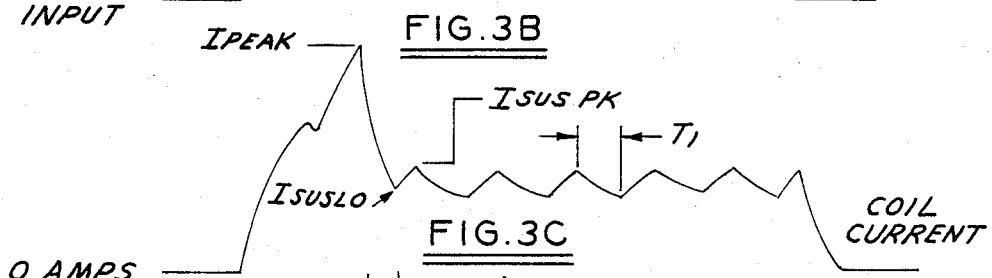
Figure 3C:
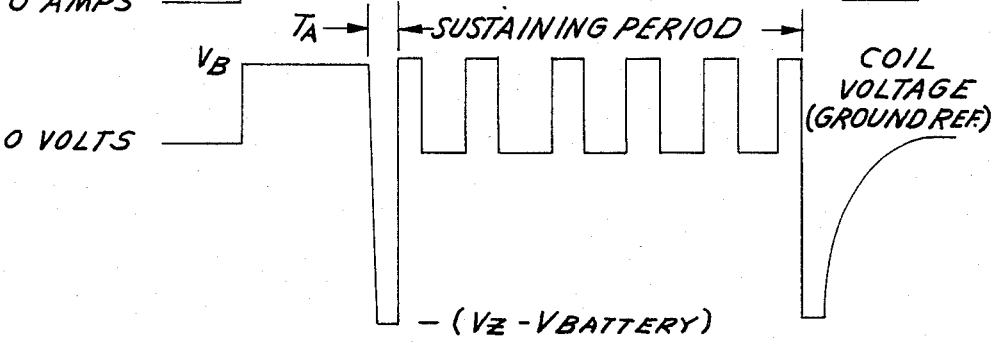

The following explanation generally applies to both sinking driver circuitry 20 of FIG. 2 and sourcing driver circuitry 40 of FIG. 4. The difference between a sinking and a sourcing driver circuit is in the method of sensing the current caused by the different configuration of the driving circuit with respect to the coil and battery. FIG. 3C, relating to sourcing drivers, is comparable to FIG. 1C, relating to sinking drivers, with inverted voltage polarities.

Referring to FIG. 2, sinking driver circuit 20 measures the current in coil 22 using sense resistor 26, one end of which is coupled to ground. The collector-emitter path of a transistor 24 is coupled in series with coil 22 and sense resistor 26 between a battery potential and a ground potential. A zener diode 27 is coupled between the base and collector of transistor 24. A noninverting amplifier 29 has a positive input coupled to a node between sense resistor 26 and the emitter of transistor 24. The voltage applied to amplifier 29 is proportional to the current in coil 22 when transistor 24 is on and during the interval TA (see FIG. 1C) which commences when the voltage at the junction of coil 22 and zener diode 27 reaches the zener diode conducting voltage and ends when the current through coil 22 and sense resistor 26 reaches a predetermined sustaining low current level.

The output of amplifier 29 is applied to the negative inputs of a comparator 31 for establishing an initial peak current level, a comparator 32 for establishing a sustaining low current level and a comparator 33 for establishing a sustaining peak current level. To this end, comparator 31 has a positive input coupled to a variable resistor 34 for providing a reference voltage at the positive input of comparator 31. The positive input is related to the initial peak current value and thus determines the occurrence of an output from comparator 31. Similarly, the positive input from comparator 32 is coupled to a resistor 35 and the positive input to comparator 33 is coupled to a resistor 36. Logic circuit 50 processes input information and applies an output to transistor 25 through a resistor 95, a transistor 90 and a resistor 93 and an output to transistor 24 through a resistor 94. Transistor 25 has an emitter-collector path coupled in parallel with coil 22 and provides a low resistance to reduce the speed of current decay in coil 22 after the sustaining peak current is first reached.

When a digital input 21 applied to logic circuit 50 goes to a logic high state, transistor 24 turns on and transistor 25 is off. Subsequently, when the predetermined initial peak current level through coil 22 is reached, transistor 24 turns off and a decay current flows through zener diode 27 and resistor 28. The current through zener diode 27 partially turns on transistor 24 thereby providing an additional decay current path.

Figure 1A:
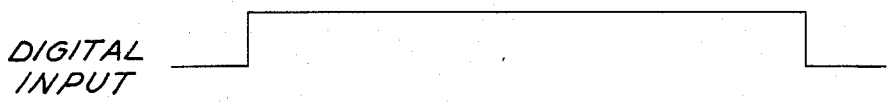
FIGS. 1A, 1B and 1C are three wave forms associated with a solenoid driving circuit coupled between the solenoid and the ground potential thereby selectively "sinking" or coupling the solenoid to ground, FIG. 1A being a digital logic signal with respect to time, FIG. 1B being a waveform representing coil current with respect to time, and FIG. 1C being a wave form representing solenoid coil voltage with respect to time.
Figure 1B:
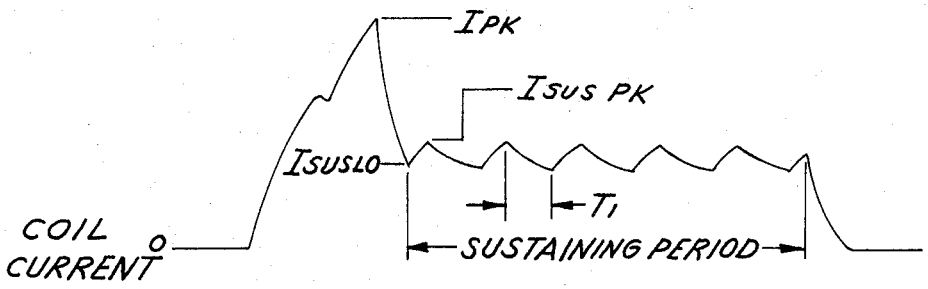
Figure 1C:
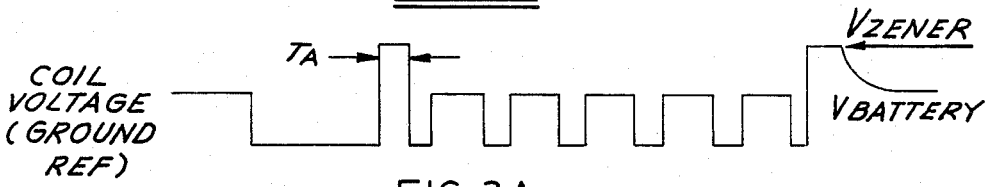

When the decay current reaches a predetermined sustaining low current level, transistors 24 and 25 turn on. This again applies current to coil 22 which increases to specified predetermined sustaining peak current, causing transistor 24 to turn off for a specified time interval $T_1$ (FIG. 1B). Since transistor 25 is on during this time, the coil decay time constant is increased because of a low resistance path inserted in parallel with coil 22 by the on condition of transistor 25. As is known, the time constant for discharging an inductive resistive circuit is inversely proportional to the resistance. A diode 88 coupled between the emitter of transistor 25 and coil 22 allows current flow through transistor 25 only during this decay period. A reduced current level is reached after time interval $T_1$ elapses. Then transistor 24 is again turned on until the sustaining peak current is again achieved at which point transistor 24 turns off for a time $T_1$. This sequence continues until the digital input 21 goes to a logic zero and indicates the termination of the desired energization of coil 22.

Thus, during the sustaining period, initiated by the decay current reaching the sustaining low current level the first time and terminated by the end of the logic 1 on digital input 21, transistor 24 is on during increasing coil current and off during decaying coil current and transistor 25 is constantly on. As a result, subequent decays from the sustaining peak current magnitude to a lower value of sustaining current are more gradual. This results in a reduced power dissipation compared to operating in a linear mode wherein a constant driving current would be applied to the solenoid coil. Also, since transistor 25 is on during the sustaining period, the frequency of the sustaining current and its duty cycle also contribute to reduced power dissipation.

Referring to sourcing driver circuit 40 of FIG. 4, the reference for the current sensing circuitry is the battery voltage, and not ground. A differential amplifier 49 senses the voltage across sense resistor 49 using a positive input on one side of a sense resistor 46 and a negative input on the other side of sense resistor 46. Operation of circuit 40 is similar to the operation of circuit 20. Transistor 44 is in series with coil 42 and controls the application of driving current to coil 42. Transistor 45 provides a low resistance path in parallel with coil 42 during the sustaining period (FIG. 3C). Diode 48 permits only a decay current, and not a driving current, through transistor 45. Zener diode 47 provides a decay current path for coil 42. Transistor 44 is actuated through a transistor 89 from logic circuit 50. The voltage across sense resistor 46 is applied to comparators 31, 32 and 33 through an amplifier 49, a transistor 91 and a resistor 92. As before, voltages from resistors 34, 35 and 36 are applied to comparators 31, 32, and 33, respectively to generate signals to be applied to logic circuit 50 which, in turn, generates outputs to be applied to transistors 44 and 45.

Figure 5:
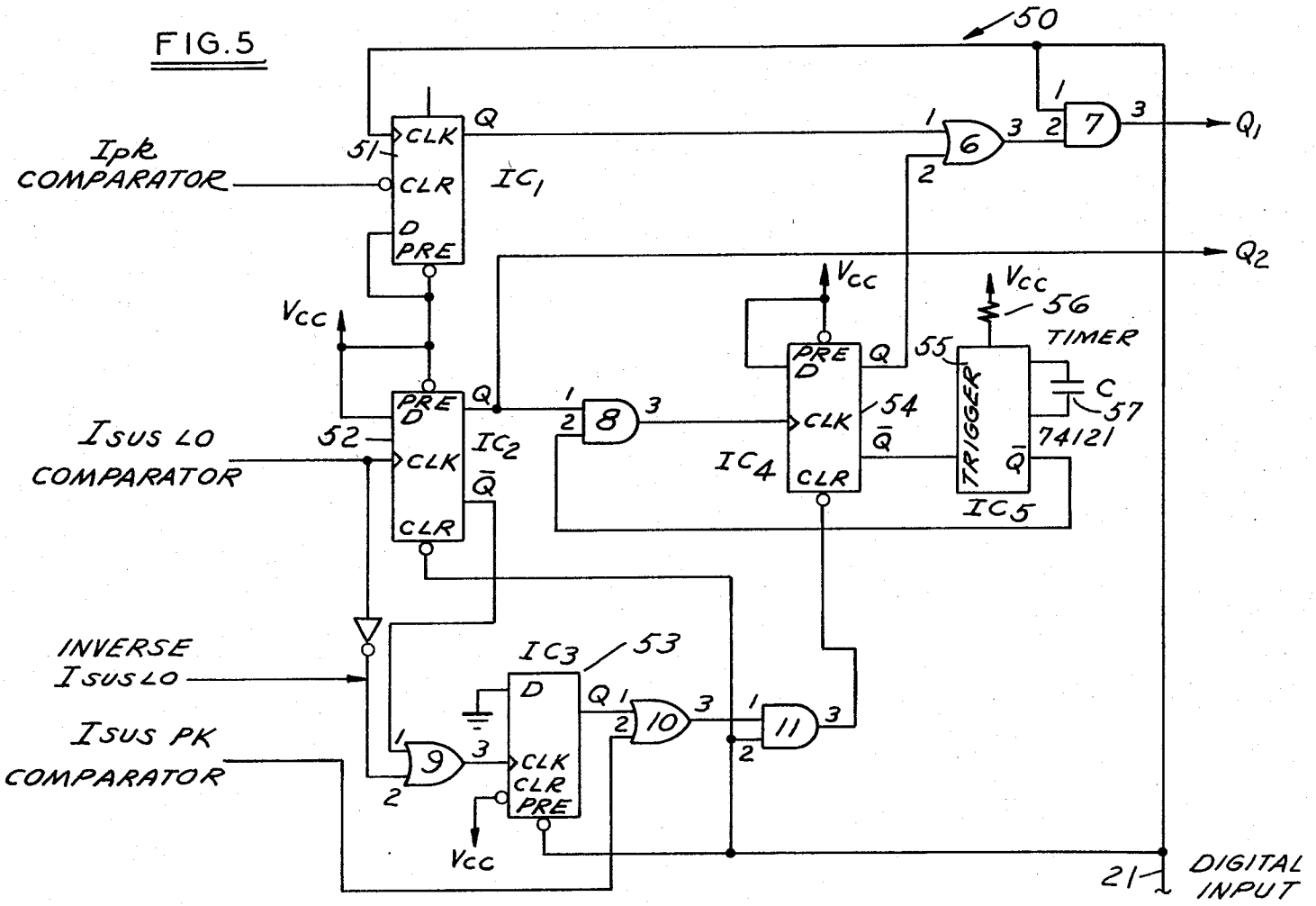
FIG. 5 is a logic schematic, partly block, diagram of a logic circuit associated with both FIGS. 2 and 4.

Referring to FIG. 5, logic circuit 50 is common to both sourcing driver circuit 40 and sinking driver circuit 20. The outputs from comparators 31, 32 and 33 are applied to inputs 51, 52 and 53, respectively, of logic circuit 50. A digital input at 21 causes cycling of the output supplied to transistors 24, and 25 of circuit 20 and transistors 44 and 45 of circuit 40. The operation of logic circuit 50 is explained below with respect to both FIG. 5 and FIGS. 6A through 6F.

LOGIC CIRCUIT OPERATION

Figures 6A, 6B, 6C, 6D, 6E, 6F:
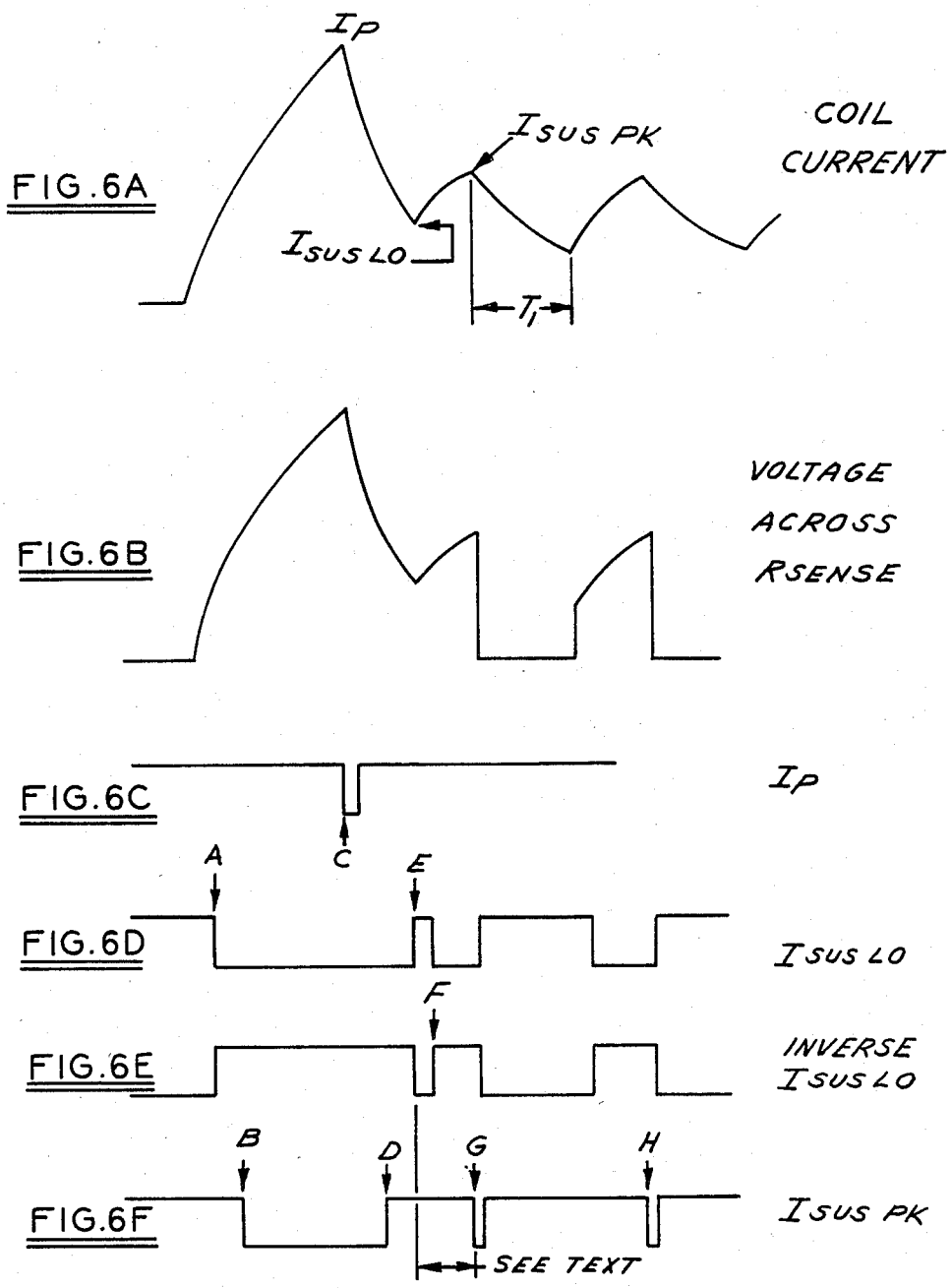
FIGS. 6A, 6B, 6C, 6D, 6E and 6F are wave forms with respect to time associated with FIG. 5 and include, coil current, voltage across the sense resistor, peak current comparator output, sustaining low current comparator output, inverse sustaining low current comparator output, and sustaining peak current comparator output, respectively.

The inputs provided by initial peak current comparator 31, sustaining low current comparator 32, and sustaining peak current comparator 33 are shown in FIGS. 6C, 6D and 6F, respectively. In FIG. 5, integrated circuits 51, 52, 53 and 54 are D-type flip-flop such as a commercially available No. 7474. Integrated circuit inputs include a clock input, a clear input, a D-input and a preset input. Outputs include a Q and an inverse of Q. When a clear input goes to a logic zero, output Q goes to a logic zero and the inverse of output Q goes to a logic one. When a logic zero is applied to the preset input, the output Q goes to a logic one and the Q inverse output goes to a logic zero. When there is a rising positive edge of a pulse applied to the clock input, the logic input level appearing at the D input is applied to the Q output and its inverse is applied to the inverse Q output.

A digital input of a logic zero is applied to input 1 of an AND gate 7. Gate 7 has an output of zero when one of its inputs is zero. The output of gate 7 is applied to transistor $Q_1$ (transistor 24 in circuit 20 and transistor 44 in circuit 40) which is turned off. When a digital input of a logic zero is applied to the clear input of integrated circuit 52, the output Q is set equal to a logic zero and applied to transistor $Q_2$ (transistor 25 in circuit 20 and transistor 45 in circuit 40) which is also turned off. Applying a logic zero digital input to the preset input of integrated circuit 53 sets the Q output of integrated circuit 53 to a logic one. When a logic zero digital input is applied to the second input of an AND gate 11, the output of AND gate 11 is applied to the clear input of integrated circuit 54 which sets the Q output of integrated circuit 54 equal to a logic zero.

When digital input 21 goes to logic one state, integrated circuit 51 sets the Q output of integrated circuit 51 equal to a logic one. Since a logic one is applied to an input 1 of an OR gate 6, the output 3 of OR gate 6 is equal to a logic one. AND gate 7 has both inputs 1 and 2 at a logic one level, one input being coupled to the digital input and the other to the output of OR gate 6 so that it has an output at pin 3 of a logic one level. This is applied to transistor $Q_1$ which is turned on. Transistor $Q_2$ is still off since integrated circuit 52 needs a zero to one transition of the sustaining low current applied to the clock input to change the state of the output of integrated circuit 52.

When the sustaining low current drops from a high to a low logic level as indicated in FIG. 6D at point A, the output of integrated circuit 52 remains the same. Also, the input to integrated circuit 53 at the clock input remains the same because the output of OR gate 9 is not changed.

When the sustaining peak current comparator drops from a logic one to logic zero level at point B of FIG. 6F, there is no change in the output of OR gate 10, to which the peak sustaining current is applied because the other input to OR gate 10 remains at a logic one.

When the peak current comparator goes from a logic one to a logic zero at point C indicated on FIG. 6C, integrated circuit 51 is cleared so that output Q is set equal to a logic zero. Further, OR gate 6 now has both input pins 1 and 2 equal to a logic zero so that the output of OR gate 6 is equal to a logic zero. This, in turn, affects the output of AND gate 7 which receives the output of OR gate 6. Transistor $Q_1$ turns off because of the logic zero applied by AND gate 7 to transistor $Q_1$. When transistor $Q_1$ turns off, the coil current starts decaying. The peak current comparator will have no further effect until the next zero to one transition of the digital input.

When the sustaining peak current comparator goes from a logic zero to a logic one, as indicated at point D, FIG. 6F, nothing changes since OR gate 10 still has a signal indicating a logic one applied to an input 1. Thus, output pin 3 of OR gate 10 still remains at a logic one.

When the sustaining low current goes from a logic zero to a logic one as indicated at point E in FIG. 6D, integrated circuit 52 toggles so that the output Q is equal to a logic one. Circuit 52 remains that way until cleared by digital input 21. With output Q of integrated circuit 52 equal to a logic one, transistor $Q_2$ turns on. The output from pin 3 of AND gate 8 applied to the clock input of integrated circuit 54 toggles integrated circuit 54 so that output Q is equal to a logic one.

Integrated circuit 55 is typically a 74121 and has a timing function. The timing function of integrated circuit 55 is not triggered since triggering requires a logic zero to one transition applied to the triggering input. The output of OR gate 6 is equal to a logic one because a logic one is applied to an input 2 from the output of integrated circuit 54. Also, the output of AND gate 7 is a logic one because both inputs are a logic one and this turns on transistor $Q_1$.

When the inverse of the sustaining low current comparator goes through a logic zero to a logic one transition as indicated at point F in FIG. 6E, integrated circuit 53 toggles since OR gate 9 has a logic zero input at pin 1. Thus, the output of OR gate 9 makes a zero to one transition due to the output of the sustaining low current comparator. This allows the sustaining peak current comparator to clear integrated circuit 54.

The purpose of integrated circuit 53 and gates 9, 10 and 11 is to prevent the sustaining peak current comparator from prematurely clearing integrated circuit 54 until after the sustaining low current comparator sets integrated circuit 53. This sometimes occurs in actual solenoid applications due to the fact that all the comparators need a considerable amount of hysteresis for noise immunity. In addition, the time interval from point E to point G can become quite small, e.g. 50 microseconds. If premature clearing of integrated circuit 54 were to occur, transistor $Q_1$ would turn off until the next digital input having a logic zero to one transition.

When the sustaining peak current has a transition from a logic one to a logic zero as indicated at point G at FIG. 6F, since pin 1 of OR gate 10 is a logic zero, the output of AND gate 11 becomes logic zero and, in turn, clears integrated circuit 54. When integrated circuit 54 clears the output, Q is a logic zero. The output of OR gate 6 goes to a logic zero. With the output of OR gate 6 equal to zero, this turns the output of AND gate 7 also equal to zero which turns off transistor $Q_1$.

During the time interval $T_1$ as indicated in FIG. 6A, from the sustaining peak current to a sustaining lower current, integrated circuit 55 is triggered by a transition of integrated circuit 54 from zero to one at the inverse Q output. After time interval $T_1$ has passed, as determined by resistor 56 and capacitor 57 coupled to integrated circuit 55, integrated circuit 54 is toggled through AND gate 8. This again turns on transistor $Q_1$.

When the sustaining peak current comparator goes from a logic high to a logic low level as indicated at point H of FIG. 6F, integrated circuit 54 is again cleared. This turns off transistor $Q_1$. Integrated circuit 55 is triggered by the inverse Q output of integrated circuit 54. After a time, $T_1$ is passed, integrated circuit 54 is toggled by gate 8. This again turns on transistor $Q_1$. This recited cycle during the sustaining continues until the digital input is again equal to zero.

Following are test results using a switching driver in accordance with an embodiment of this invention in comparison with a linear driver on various fuel injector and transmission solenoids. The power dissipation of such a switching driver is substantially less than the power dissipation of a linear driver.

| | TOTAL POWER DISSIPATION OF DRIVER TRANSISTOR(S) - WATTS | |
|---|---|---|
| LOAD | LINEAR DRIVER | SWITCHING DRIVER |
| Fuel injector<br>R = 2.4 ohms<br>L = 4 mh | 6 | 2 |
| Transmission solenoid<br>R = 1.5 ohms<br>L = 4 mh | 12 | 5 |

Various modifications and variations will no doubt occur to those skilled in the various arts to which this invention pertains. For example, the circuit components coupled to the logic circuit may be varied from that described herein. These and all other variations which basically rely on the teachings through which this disclosure has advanced the art are properly considered within the scope of this invention as defined by the appended claims.

I claim:

1. A solenoid driver circuit for controlling application of current to a solenoid and reducing the total power dissipation during activation of the solenoid, said solenoid driver circuit including:

a first and a second transistor means coupled to the solenoid;

a sense resistor coupled in said solenoid driver circuit to sense current flowing in the solenoid;

a Zener diode coupled in series with said sense resistor and the solenoid so as to provide a current decay path in series with said sense resistor thereby providing an indication of solenoid current by the voltage drop across said sense resistor;

a first comparator means coupled to said sense resistor to compare the sensed current of the solenoid to a first control current representative of a desired initial peak current in the solenoid;

a second comparator means coupled to said sense resistor to compare the sensed current of the solenoid to a second control current representative of a desired low sustaining current in the solenoid;

a third comparator means coupled to said sense resistor to compare the sensed current of the solenoid to a third control current representative of a desired sustaining peak current in the solenoid;

logic means coupled to said first, second and third comparator means and said first and second transistor means so as to receive input signals which are a function of the solenoid current and the first, second and third control currents, for switching said first and second transistor means on and off as a function of the output of said first, second and third comparator means so that an initial peak current level is applied to the solenoid, there is a relatively rapid current decay to a predetermined low sustaining current level, another increase in driving current to the solenoid to a sustaining peak current level, said sustaining peak current level being less in magnitude than said initial peak current magnitude; and said logic means including:

a timer means for establishing a predetermined current decay time from the sustaining peak current level so that after an increase in solenoid driving current to the sustaining peak current magnitude there occurs a subsequent slower current decay, relative to said rapid current decay, for a predetermined time period;

a first flip-flop means coupled to said first comparator means for generating a logic state;

a second flip-flop means coupled to said second comparator means for generating a logic state;

a first OR gate means coupled to said second comparator;

a second OR gate coupled to said third comparator and said third flip-flop means;

a first AND gate coupled to said second flip-flop means;

a second AND gate means coupled to said second OR gate means and adapted to receive a digital input;

a fourth flip-flop means coupled to said first and second AND gate means for generating a logic signal;

a first timer means coupled to said fourth flip-flop means and said first AND gate for timing the length of said predetermined current decay period;

a third OR gate means coupled to said first and fourth flip-flop means;

a third AND gate coupled to said third OR gate and to the digital input;

said first transistor means being coupled to said third AND gate means; and said second transistor means being coupled to said second flip-flop means.

2. A solenoid driver circuit as recited in claim 1 wherein:

said first transistor means has an emitter-collector path coupled in series with the solenoid and said sense resistor;

said second transistor means has an emitter-collector path coupled in parallel with the solenoid; and said logic means being adapted, as a function of current in the solenoid, to turn on said first transistor means until the solenoid current reaches the initial peak current, turn off said first transistor means upon reaching the initial peak current in the solenoid, turn on said first and second transistor means when the solenoid current decays to a predetermined low sustaining current level, and maintain said second transistor in an on state and said logic means being further adapted, as a function of the predetermined decay time and the sustaining peak current magnitude to switch said first transistor between on and off states to vary solenoid current between the peak sustaining current level and a lower current level during a sustaining period including a plurality of predetermined current decay periods.

3. A solenoid driver circuit as recited in claim 2 wherein said sense resistor is coupled between said first transistor means and a source voltage potential and an input to said first, second and third comparators is coupled to detect a voltage across said sense resistor.

4. A solenoid driver circuit as recited in claim 3 wherein said first, second and third comparators are coupled to said sense resistor through a differential amplifier, coupled to the voltage across said sense resistor, a control transistor and a current detecting resistor.

5. A solenoid driver circuit as recited in claim 4 further comprising:

a first diode coupled in series with the emitter-collector path of said second transistor means so the series combination of said first diode and said second transistor means is in parallel with the solenoid;

said Zener diode being coupled between the base and collector of said first transistor means;

a first resistor coupled between the base of said first transistor means and the voltage source so that the series combination of said Zener diode and said first resistor is in parallel with the series combination of said sense resistor and said first transistor means, and;

a third transistor means having a base coupled to said logic means and an emitter-collector path coupled to the base of said first transistor means so as to apply a control signal from said logic means to said first transistor means.

6. A solenoid driver circuit as recited in claim 2 wherein said sense resistor is coupled between said first transistor means and ground potential and an input to said first, second and third comparators is coupled to a node between said sense resistor and said first transistor means.

7. A solenoid driver circuit as recited in claim 6, wherein said first, second and third comparators are coupled to said sense resistor through a first amplification means.

8. A solenoid driver circuit as recited in claim 7 further comprising:

a diode coupled in series with the emitter-collector path of said second transistor means so that the combination of said diode and second transistor means is in parallel with the solenoid;

a third transistor means having a base coupled to said logic means and an emitter-collector path coupled to the base of said second transistor means for applying a control signal for said logic means to said second transistor means; and the base of said first transistor means being coupled to said logic means through a first resistor and to the emitter of said first transistor through a second resistor.

9. A solenoid driver as recited in claims 8 or 5 wherein said first timer means has a trigger input coupled to said fourth flip-flop means and an output coupled to an input of said first AND gate so as to act as a timing means.

10. A solenoid driver as recited in claim 9 wherein said first flip-flop means has a clock input coupled to the digital input, a clear input coupled to said first comparator means, a pre and a D input coupled to a voltage source, and a Q output coupled to an input of said third OR gate.

11. A method for controlling coupling of a voltage source and application of current to a solenoid coil and reducing the total power dissipation during activation of the solenoid, said method including the steps of:

applying a driving current to the solenoid until a predetermined initial peak current is reached;

causing a relatively rapid decay in the solenoid current until a predetermined sustaining low current is reached;

applying a driving current to the solenoid, by turning on a first transistor coupled in series with the solenoid and the voltage source, until a predetermined sustaining peak current is reached;

sensing voltage across a sense resistor coupled in series with the solenoid and comparing the sensed voltage to a reference voltage established as a function of the initial peak current magnitude, the sustaining peak current being smaller in magnitude than the initial peak current, and comparing the sensed voltage to a reference voltage established as a function of the sustaining peak current;

causing a decay in the solenoid current for a predetermined length of time to a reduced current level, by coupling a second transistor in parallel with the solenoid, turning on the second transistor to reduce the resistance in parallel with the solenoid thereby increasing the solenoid current decay time constant, and turning off the second transistor as a function of the predetermined length of time, the rate of decay being less than the rate of the relatively rapid decay;

switching between applying a driving current to reach the sustaining peak current and causing a decay for a predetermined length of time during the remaining desired activation period of the solenoid turning the first transistor on and off as a function of the sustaining peak current magnitude and the predetermined length of time during desired activation of the solenoid;

said step of causing a relatively rapid decay including the steps of determining the initial peak current has been reached, turning off the first transistor and passing a decay current through a Zener diode coupled in series with the sense resistor; and said steps of turning the first and second transistors on and off includes using logic flip-flop means to sense voltage comparisons with the initial peak current voltage, the sustaining peak current, and the sustaining low current, generating a logic signal which is a function of the predetermined length of time, and generating output signals to be coupled to the bases of the first and second transistors to control the on/off states of the first and second transistors.

* * * * *